US009232841B1

(12) United States Patent
Hsu

(10) Patent No.: US 9,232,841 B1
(45) Date of Patent: Jan. 12, 2016

(54) HAIR CLIP WITH ELASTIC FASTENER

(71) Applicant: Shih-Ling Hsu, Tainan (TW)

(72) Inventor: Shih-Ling Hsu, Tainan (TW)

( * ) Notice: Subject to any disclaimer, the term of this patent is extended or adjusted under 35 U.S.C. 154(b) by 0 days.

(21) Appl. No.: 14/587,049

(22) Filed: Dec. 31, 2014

(51) Int. Cl.
*A45D 8/20* (2006.01)
*A45D 8/22* (2006.01)

(52) U.S. Cl.
CPC ... *A45D 8/20* (2013.01); *A45D 8/22* (2013.01)

(58) Field of Classification Search
CPC ..... A45D 8/20; A45D 8/22; A45D 8/24; A45D 8/28; A45D 8/30; A45D 8/32; A45D 8/34; A45D 8/36; A45D 8/00; A45D 8/12; A45D 8/14; A45D 8/16; A45D 2/42
USPC ..... 132/277, 144–146, 156, 157, 273, 276, 132/279, 162, 163, 278; D28/32, 33, 34, D28/40–43; 24/531, 455, 457, 458, 499, 24/504, 506
See application file for complete search history.

(56) References Cited

U.S. PATENT DOCUMENTS

| | | | | | |
|---|---|---|---|---|---|
| 2,459,926 | A * | 1/1949 | D'Alberto | 132/277 |
| 2,830,345 | A * | 4/1958 | Fernberg | 24/458 |
| 5,494,060 | A * | 2/1996 | Potut | 132/277 |
| D381,119 | S * | 7/1997 | Chang | D28/40 |
| D381,767 | S * | 7/1997 | Chang | D28/40 |
| 5,697,388 | A * | 12/1997 | Chang | 132/277 |
| 6,035,863 | A | 3/2000 | Mao | |
| 6,562,938 | B2 * | 5/2003 | Haile et al. | 528/271 |
| 7,211,633 | B2 * | 5/2007 | DeBruin | 526/64 |
| D642,738 | S * | 8/2011 | Hsu | D28/40 |
| 8,066,018 | B2 * | 11/2011 | Hsu | 132/277 |
| 8,181,658 | B2 | 5/2012 | Hsu | |
| 2008/0149129 | A1 * | 6/2008 | Yang | 132/277 |
| 2009/0277469 | A1 * | 11/2009 | Hsu | 132/277 |

* cited by examiner

*Primary Examiner* — Vanitha Elgart
(74) *Attorney, Agent, or Firm* — Alan D. Kamrath; Kamrath IP Lawfirm, P.A.

(57) ABSTRACT

A hair clip includes two hinged clip bodies and an elastic fastener. Each clip body includes a press portion with a through-hole therein. Each clip body further includes a clamp portion extending from the press portion and having a recess in an outer surface thereof. The elastic fastener includes two spaced end portions and a central portion between the end portions. The end portions of the elastic fastener respectively penetrate the through-holes in the press portions of the clip bodies and are engaged in the recesses in the clamp portions for positioning. The elastic fastener has a roughly elliptic cross section which contributes to service life of the hair clip.

3 Claims, 6 Drawing Sheets

HAIR CLIP WITH ELASTIC FASTENER

BACKGROUND OF THE INVENTION

1. Field of the Invention

The present invention relates to a hair clip and, more particularly, to an elliptic elastic fastener for claw hair clips.

2. Description of the Related Art

In general, a claw hair clip includes two clip bodies, a spring, and a shaft rod connecting the clip bodies and the spring. The spring force allows the clip bodies to hold and secure the hair. However, the spring of the existing hair clip is exposed to the exterior of the hair clip, causing ill effect on the hair clip appearance. Moreover, the exposed spring is easily rusted and might injure a user's finger by accident.

A hair clip device disclosed in U.S. Pat. No. 6,035,863 includes an elastic retainer and two clamp devices. The elastic retainer engages with the clamp devices. Each clamp device has a blocking plate, two oblong holes, and two protruded bars. The elastic retainer has a slot, two through holes, and two distal click plates. Each distal click plate has a recess. Each through hole receives an upper portion of the respective clamp device. As a spring's substitute, the elastic retainer applies resilience on the clamp devices and makes them close inward. However, the oblong holes formed in the clamp devices with which the elastic retainer is coupled attenuate strength of the clamp devices and accelerate fractures in a period. Furthermore, the elastic retainer, which is developed with the slot opened in a hollow cylinder, is easily broken. Specifically, both ends of the elastic retainer linking the clamp devices are shifted outward when the clamp devices are opened. The two ends of the elastic retainer are opened wide because of a circular profile of the elastic retainer (see FIG. 4 in U.S. Pat. No. 6,035,863). Accordingly, the elastic retainer, which is frequently opened and closed, is easily fractured. Moreover, it takes more labor force and time in assembling the elastic retainer and the clamp devices, because these components are assembled inconveniently.

BRIEF SUMMARY OF THE INVENTION

Thus, an objective of the present invention is to provide a hair clip with an elastic fastener from which an inward resilience is applied on two clip bodies of the hair clip to close. The elastic fastener has a roughly elliptic cross section which effectively extends service life of the elastic fastener.

To achieve this and other objectives, a hair clip of the present invention includes two hinged clip bodies and an elastic fastener. Each clip body includes a press portion and a clamp portion extending from the press portion. The press portion of each clip body includes a through-hole therein, and the clamp portion of each clip body includes a recess formed in an outer surface thereof. The elastic fastener includes two spaced end portions defined by a gap therebetween and a central portion integrally connected between the end portions. The elastic fastener has a roughly elliptic cross section, and the central portion has a roughly semi-elliptic cross section. The end portions of the elastic fastener penetrate the through-holes in the two clip bodies and are engaged in the recesses in the clamp portions respectively.

In a preferred form, the elastic fastener presents a C-shaped profile, and the central portion of the elastic fastener is greater than each of the end portions of the elastic fastener in radial thickness.

In a preferred form, the elastic fastener is made of a polymerized plastic mixture including 1,4-cyclohexanedimethanol (CHDM), ethylene glycol (EG), phosphotungstic acid (PTA), optical brightener and butadiene-styrene copolymer.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

DETAILED DESCRIPTION OF THE INVENTION

Figure 1:
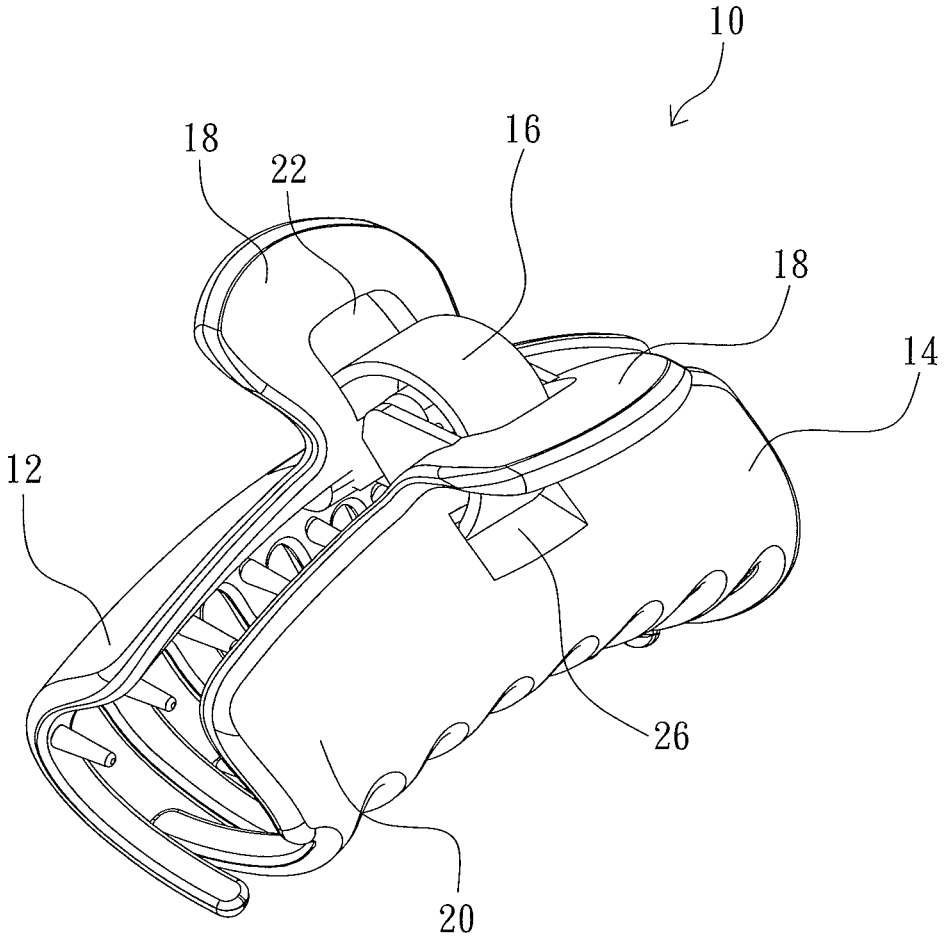
FIG. 1 is a perspective view of a hair clip with an elastic fastener according to a first embodiment of the present invention.
Figure 2:
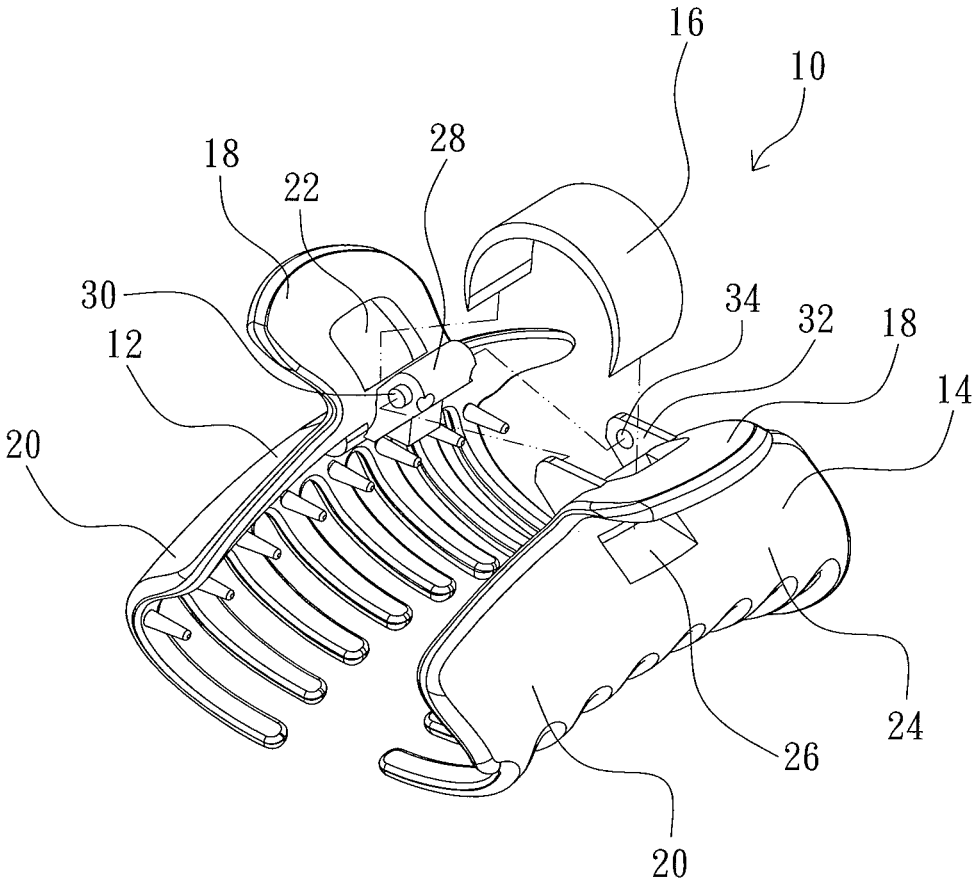
FIG. 2 is an exploded view of the hair clip of FIG. 1.

A claw hair clip 10 according to a first embodiment of the present invention is shown in FIGS. 1 through 4 of the drawings and includes first and second clip bodies 12 and 14 and an elastic fastener 16. Each of the clip bodies 12, 14 includes a press portion 18 and a claw clamp portion 20 extending downwards from the press portion 18. Each press portion 18 has a through-hole 22 therein. Each clamp portion 20 has an outer surface 24 in which a recess 26 adjacent to the press portion 18 is developed. The press portion 18 of the first clip body 12 has a raised pivotal portion 28 at an internal side thereof, and two axle portions 30 are provided on two ends of the pivotal portion 28. The clamp portion 20 of the second clip body 14 internally includes two spaced coupling seats 32, and each of the coupling seats 32 is formed with a cavity 34 in an inner surface thereof.

Figure 3:
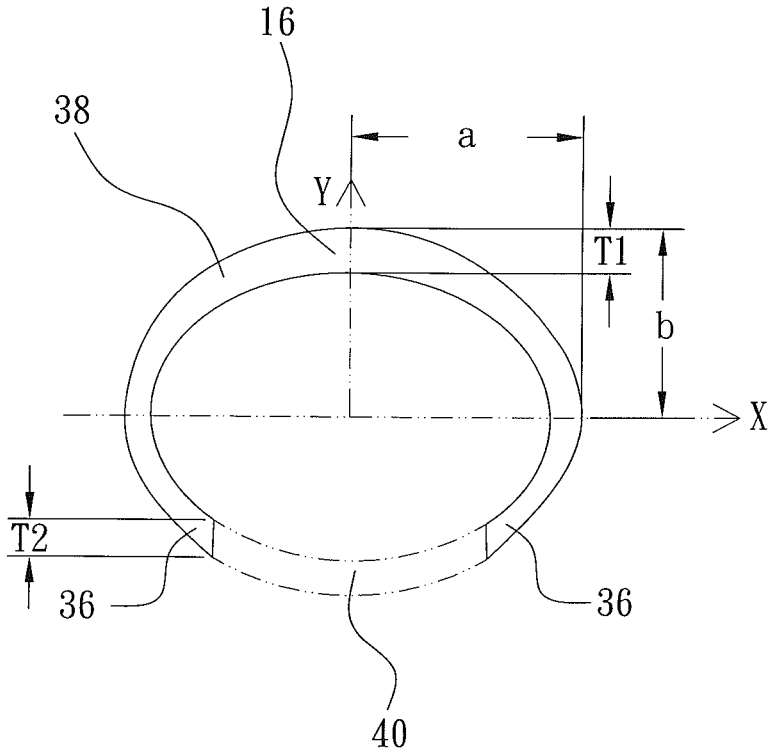
FIG. 3 is a plan view of the elastic fastener of the hair clip of FIG. 1.
Figure 4:
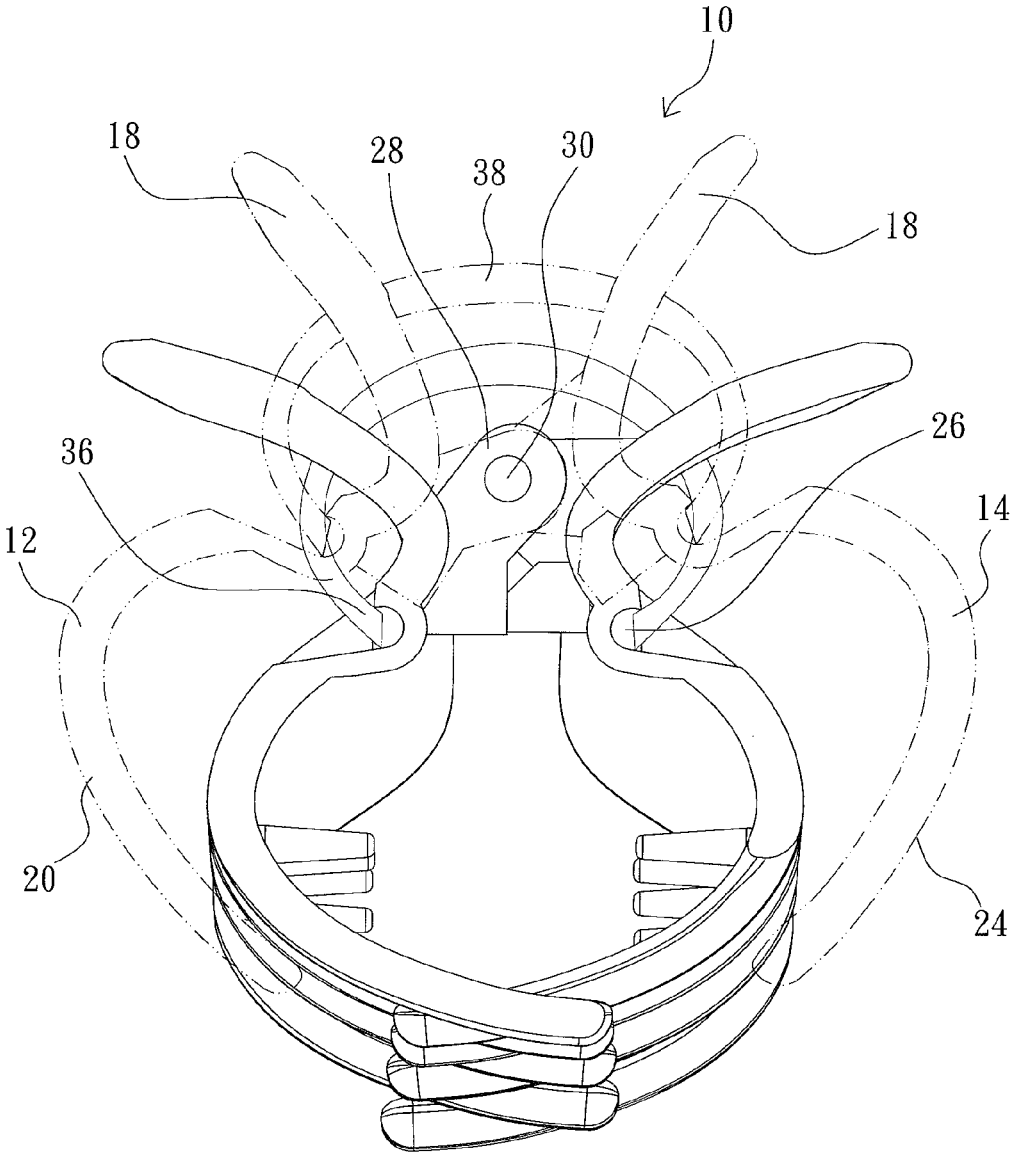
FIG. 4 is a cross-sectional view of the hair clip of FIG. 1.

The elastic fastener 16 includes two spaced end portions 36 and a central portion 38 integrally connected between the end portions 36. The end portions 36 are defined by a gap 40 therebetween, such that the elastic fastener 16 presents a C-shaped profile. In the embodiment, the central portion 38 of the elastic fastener 16 has a first radial thickness (T1), and each of the end portions 36 has a second radial thickness (T2) which is less than the first radial thickness (T1). In another embodiment, the radial thicknesses of the elastic fastener 16 decrease gradually from the central portion 38 to each of the end portions 36. As shown in FIG. 3 and FIG. 4, the whole profile of the elastic fastener 16 presents an ellipse or a shape like an ellipse, and the central portion 38 has a roughly semi-elliptic profile. Specifically, the semi-elliptical central portion 38 defines a major axis (X-axis) and a minor axis (Y-axis) in which a semi-major axis radius (a) is greater than a semi-minor axis radius (b), and the ratio of the semi-minor axis radius to the semi-major axis radius (b/a) is about 0.6-0.9 preferably.

During installation of the hair clip 10, the pivotal portion 28 of the first clip body 12 is held between the coupling seats 32 of the second clip body 14, and the axle portions 30 are respectively inserted into the cavities 34 in the coupling seats 32, so that the clip bodies 12 and 14 pivotally fit together. Furthermore, the end portions 36 of the elastic fastener 16 penetrate the through-holes 22 in the press portions 18 and are engaged in or abut against the recesses 26 in the clamp portions 20 respectively for positioning (FIG. 4), creating resilience to close the clamp portions 20 of the clip bodies 12, 14.

A user who tries to fix her hairs with the hair clip 10 should apply a force on and open the press portions 18 of the clip bodies 12, 14 by fingers. The clamp portions 20 of the clip bodies 12, 14 under effect of resilience from the elastic fastener 16 are closed when force applied on the press portions 18 is released, allowing a lock of gathered hair to be retained by the hair clip 10.

Figure 5:
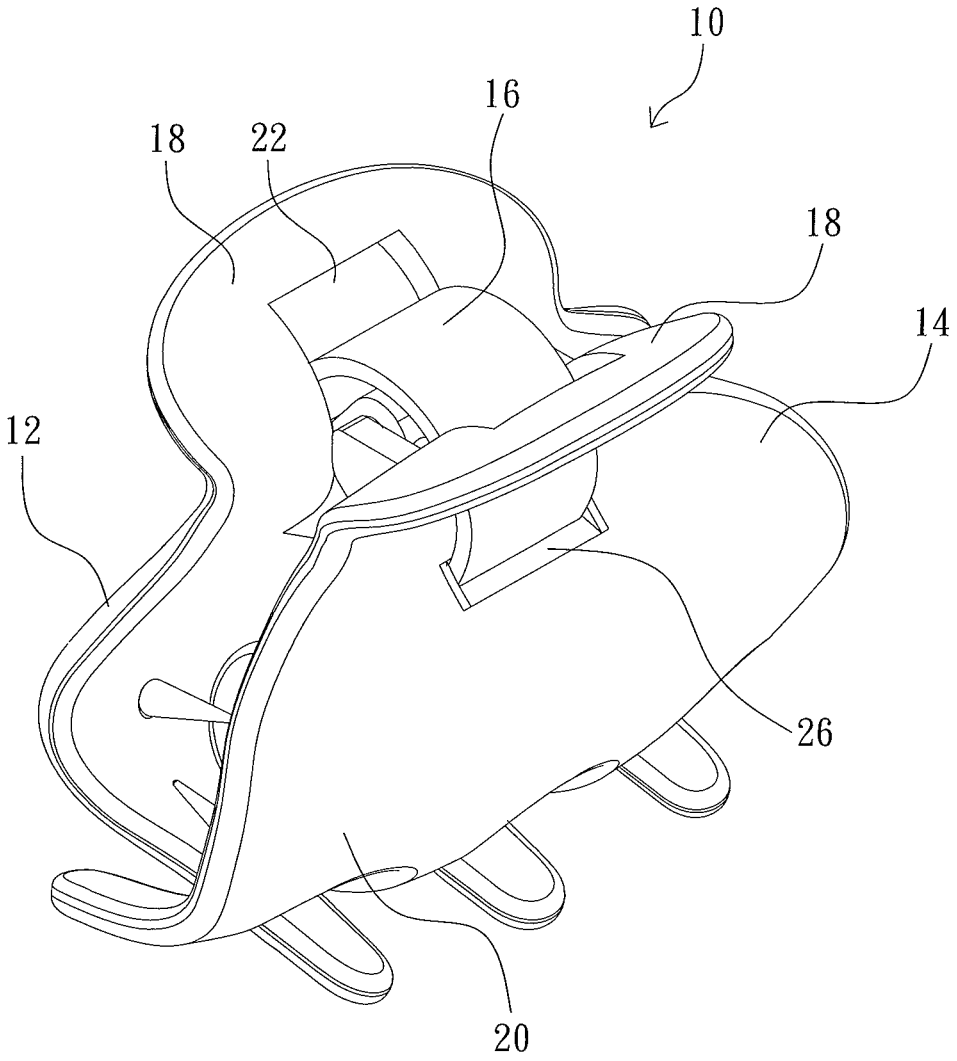
FIGS. 5 and 6 are perspective views illustrating two claw hair clips according to other two embodiments of the present invention.
Figure 6:
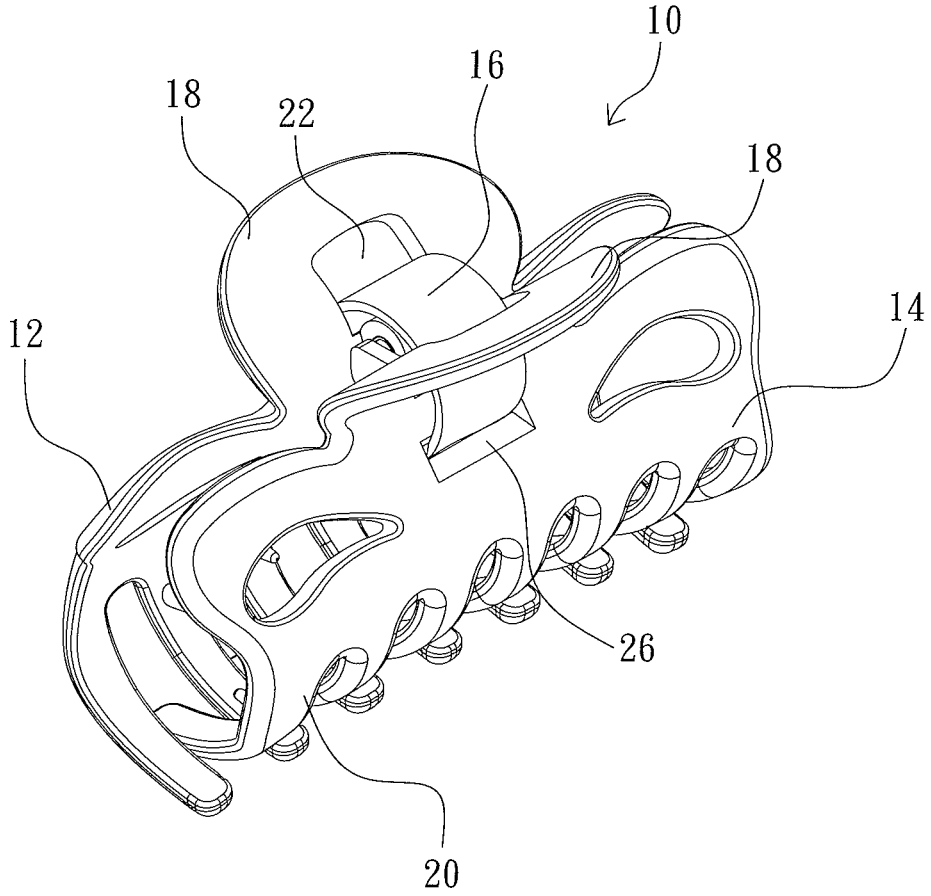

The shape of the first and second clip bodies 12 and 14 is not limited to the embodiments illustrated in FIGS. 1 through 4. As shown in FIGS. 5 and 6, the first and second clip bodies 12 and 14 can be of different styles, allowing the users to choose between different designs according to various needs.

The hair clip 10 of the present disclosure features advantages and effect in use as follows:

1. The end portions 36 of the elastic fastener 16 subject to the roughly elliptic profile of the elastic fastener 16 are opened less when the clamp portions 20 are shifted outward (see FIG. 4). Thus, the elastic fastener 16 is not broken and contributes to extended service life of the hair clip 10 in long-term use. Moreover, the central portion 38 of the elastic fastener 16, which is greater than each of the two end portions 36 in radial thickness, sustains more stress and strengthens durability of the elastic fastener 16 without fracture when the clamp portions 20 are opened. In addition, the elastic fastener 16 made of plastic material rather than metal is an environment-friendly component with sufficient flexibility and resilience but with no drawback such as fracture and premature failure.

2. The clip bodies 12, 14 with no through-hole opened in the clamp portions 20 can be coupled with the elastic fastener 16 properly for better structural strength.

3. The elastic fastener 16 and the clip bodies 12, 14, both of which are easily assembled, contribute to cost efficiency and throughput.

Furthermore, in order to avoid rupture, breakage and whiten-crazing, the bent portions also feature a re-plasticization ability to prevent the elastic fastener 16 of the present invention from aging. The material of the elastic fastener 16 utilizes the technology of U.S. Pat. No. 8,181,658, the entire contents of which are incorporated herein by reference. Specifically, the elastic fastener 16 of the present invention is preferably made of a polymerized plastic mixture including 1,4-cyclohexanedimethanol (CHDM), ethylene glycol (EG), phosphotungstic acid (PTA), optical brightener and butadiene-styrene copolymer. Thereby, the elastic fastener product of the present invention also features good malleability, re-plasticization ability and tenacity as well as good artistic effect in shining brightness and eco-friendly effect.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A hair clip comprising:

two hinged clip bodies, with each of the two clip bodies including a press portion and a clamp portion extending from the press portion, with a through-hole formed in the press portion of each of the two clip bodies, with the clamp portion of each of the two clip bodies including a recess formed in an outer surface thereof; and an elastic fastener including two spaced end portions and a central portion between the two end portions, with the two end portions defined by a gap therebetween, with the elastic fastener having a roughly elliptic cross section, with the central portion having a roughly semi-elliptic cross section, with the two end portions of the elastic fastener penetrating the through-holes in the press portions of the two clip bodies and engaged in the recesses of the clamp portions of the two hinged clip bodies respectively, wherein the elastic fastener presents a C-shaped profile, with the central portion of the elastic fastener being greater than each of the two end portions of the elastic fastener in radial thickness.

2. The hair clip according to claim 1, wherein the central portion of the elastic fastener defines a major axis and a minor axis in which a semi-major axis radius is greater than a semi-minor axis radius, and wherein the ratio of the semi-minor axis radius to the semi-major axis radius is about 0.6-0.9.

3. The hair clip according to claim 1, wherein the elastic fastener is made of a polymerized plastic mixture including 1,4-cyclohexanedimethanol (CHDM), ethylene glycol (EG), phosphotungstic acid (PTA), optical brightener and butadiene-styrene copolymer.

* * * * *